US006315386B1

(12) United States Patent
Bailey et al.

(10) Patent No.: US 6,315,386 B1
(45) Date of Patent: Nov. 13, 2001

(54) INK JET MAINTENANCE STATION HAVING ACOUSTIC DAMPENING

(75) Inventors: Thomas Allen Bailey, Frankfort; Christopher Keith Caspar, Shelbyville; John Richard Schlumpf, Lexington, all of KY (US); Takao Hashimoto, Anan (JP)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/577,656

(22) Filed: May 24, 2000

(51) Int. Cl.[7] ..... B41J 29/08; B41J 29/10
(52) U.S. Cl. ..... 347/22; 347/29; 347/32
(58) Field of Search ..... 347/22, 29, 32, 347/33, 30; 400/689

(56) References Cited

U.S. PATENT DOCUMENTS

| | | |
|---|---|---|
| 4,441,110 | 4/1984 | Hatakeyama et al. . |
| 5,357,275 | 10/1994 | Ikado et al. . |
| 5,440,331 | 8/1995 | Grange . |
| 5,455,609 | 10/1995 | Gast et al. . |
| 5,517,219 | 5/1996 | Uchida . |
| 5,563,637 | 10/1996 | Francis et al. . |
| 5,563,638 | 10/1996 | Osborne . |
| 5,621,441 | 4/1997 | Waschauser et al. . |
| 5,627,573 | 5/1997 | Fahy . |
| 5,627,574 | 5/1997 | Fahy . |
| 5,699,092 | 12/1997 | Kawakami et al. . |
| 5,712,668 | 1/1998 | Osborne et al. . |
| 5,714,991 | 2/1998 | Osborne et al. . |
| 5,757,395 | 5/1998 | Chew et al. . |
| 5,847,727 | 12/1998 | VanLiew et al. . |
| 5,847,728 | 12/1998 | Lee . |

*Primary Examiner*—Huan Tran
(74) *Attorney, Agent, or Firm*—Jacqueline M. Daspit; Ronald K. Aust

(57) ABSTRACT

An ink jet printer includes a printer frame and a maintenance station coupled to the printer frame. The maintenance station includes a maintenance frame having a first side. The first side has formed therein at least a first guide slot and a first flexible end-stop member associated with the first guide slot. A maintenance sled is provided which is movable within the maintenance frame in a first direction. The maintenance sled has a first guide member positioned to slideably ride in the first guide slot. A travel limit of the first guide member in the first direction is defined by the first flexible end-stop member.

13 Claims, 2 Drawing Sheets

INK JET MAINTENANCE STATION HAVING ACOUSTIC DAMPENING

BACKGROUND OF THE INVENTION

1. Field of the Invention

The present invention relates to a maintenance station in an ink jet printing apparatus and, more particularly, to a maintenance station having acoustic dampening.

2. Description of the Related Art

A maintenance station for an ink jet printing apparatus generally performs maintenance operations to preserve the life of the ink jet printhead. The maintenance station includes a wiper for wiping residual ink from the nozzles of the ink jet printhead after completion of printing and a capping mechanism to cap the ink jet printhead for storage. The wiping and capping operations prevent the nozzles from becoming blocked and extend the life of the ink jet printhead.

One such maintenance station is configured to minimize the occupied space. The maintenance station includes a movable cap carriage, or maintenance sled, supporting a printhead cap. The cap is engageable with an ink jet printhead of the ink jet printing apparatus. A cover frame surrounds the maintenance sled and includes guide slots for receiving the corresponding guide pins of the maintenance sled, respectively. When the printing carriage engages a printing carriage engaging member of the maintenance station, the guide pins are caused to ride in the guide slots, enabling the movable maintenance sled to be shifted from a recessed position to an engaged position where the cap engages the ink jet printhead. Typically, a spring is disposed between the movable cap carriage and a cover frame to facilitate the return of the movable maintenance sled from the engaged position to the recessed position. However, when the movable maintenance sled returns from the engaged position to the recessed position, an unacceptable amount of noise is generated as the guide pins of the maintenance sled contact the rigid end-stops of the respective guide slots of the cover frame.

What is needed in the art is maintenance station which includes a mechanism to reduce the noise associated with the return of the maintenance sled to the recessed position.

SUMMARY OF THE INVENTION

The present invention provides an acoustic dampening mechanism in the form of a flexible end-stop for the maintenance station guide slots which is effective in reducing the noise associated with the collision between the maintenance station frame and the maintenance station sled at the end of a printhead maintenance operation.

The invention comprises, in one form thereof, a printer frame and a maintenance station coupled to the printer frame. The maintenance station includes a maintenance frame having a first side. The first side has formed therein a first guide slot and a first flexible end-stop member associated with the first guide slot. A maintenance sled is provided which is movable within the maintenance frame in a first direction. The maintenance sled has a first guide member positioned to slideably ride in the first guide slot. A travel limit of the maintenance station in the first direction is defined by the first flexible end-stop member.

An advantage of the present invention is that maintenance station noise generation is reduced in a simple and cost effective manner by the inclusion of the flexible end-stop member in association with the guide slot.

Another advantage is that the impact force of the maintenance sled contacting the end-stops of the maintenance frame is reduced, thereby reducing the chances of part failures associated with this impact.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
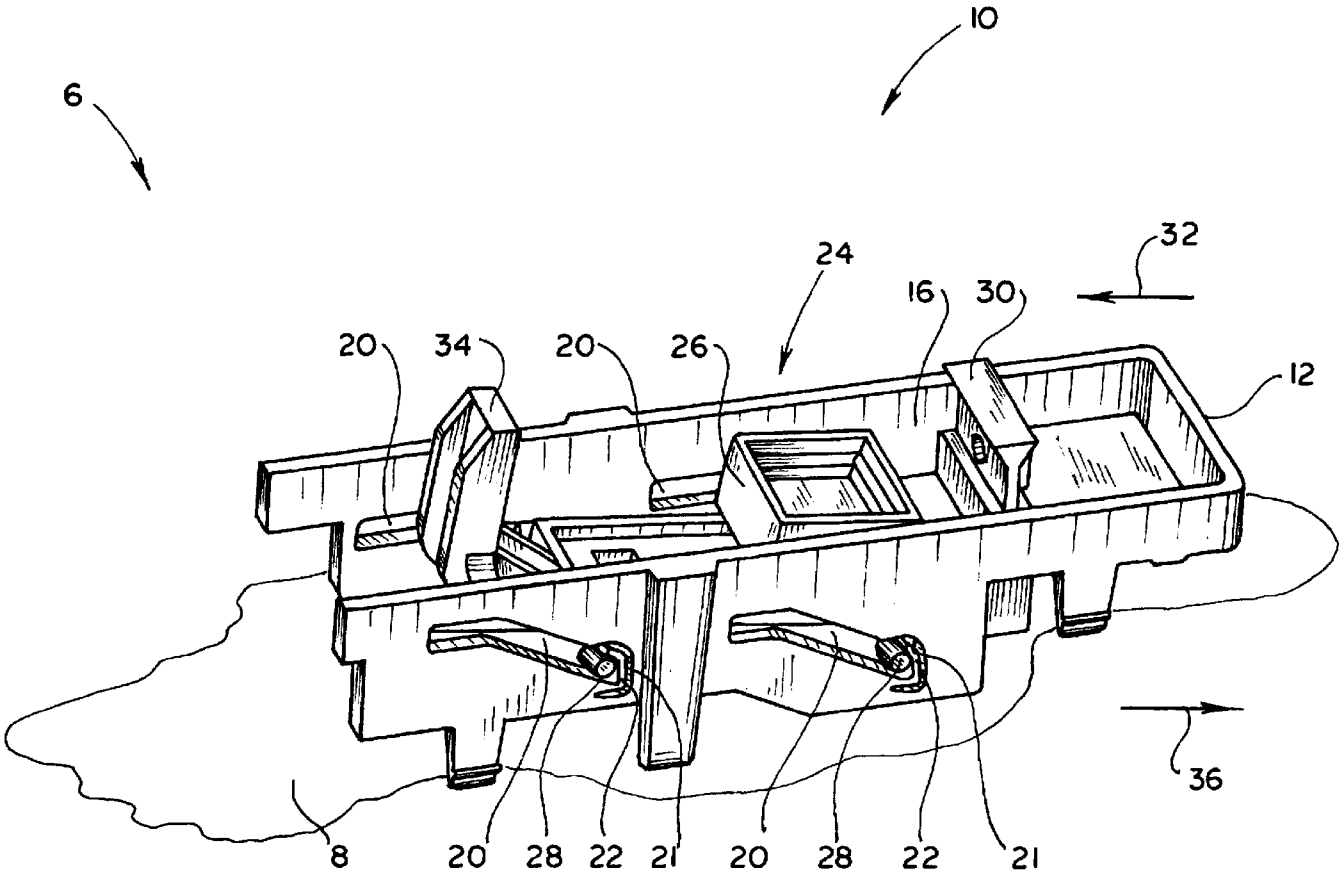
FIG. 1 is a view of a portion of an ink jet printer showing in perspective the maintenance station of the invention, with the maintenance sled in the recessed position.

Referring now to the drawings and particularly to FIG. 1, there is shown a portion of an ink jet printer 6 having a printer frame 8 to which a maintenance station 10 of the invention is attached. In particular, the maintenance station 10 includes a maintenance frame 12 and a movable maintenance sled 14.

Maintenance frame 12 forms a substantially rectangular structure having two opposed sides 16 and 18. In preferred embodiments, each of sides 16 and 18 of frame 12 includes two guide slots 20, two corresponding auxiliary channels 21, and two corresponding flexible end-stop members 22. The angle of incline of each of guide slots 20 is substantially identical. As shown in reference to FIGS. 1 and 2, slots 20 and auxiliary channels 21 are located in sides 16, 18 of maintenance frame 12 to define the shape of corresponding flexible end-stop members 22. Preferably, each end-stop member 22 is configured as a hook-shape, however, other shapes (such as flat or S-shaped) for flexible end-stop members 22 are possible. In a most preferred design, each flexible end-stop member 22 is sized to be deflectable upon initial contact by the engaging portions of maintenance sled 14, but resilient enough to return to a predeflection position after the initial contact with the engaging portions.

Figure 2:
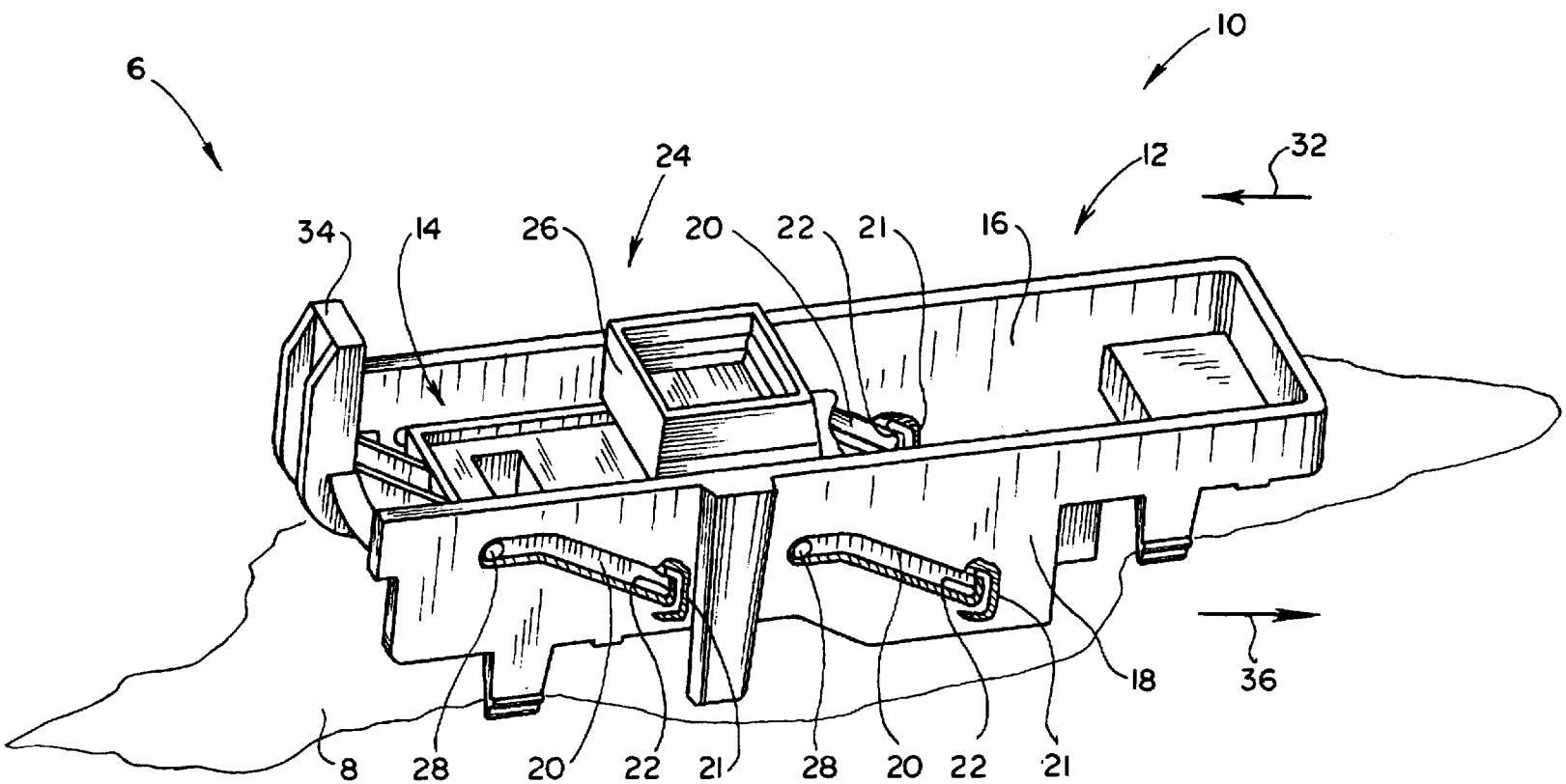
FIG. 2 is a view of a portion of an ink jet printer showing in perspective the maintenance station of the invention, with the maintenance sled in the capping position.

Maintenance sled 14 is moveable within frame 12, and includes a capping assembly 24 supporting a printhead cap 26, four guide pins 28 (two pins 28 in one side of sled 14 can be seen in FIGS. 1 and 2), and a printhead wiper 30. In FIG. 2, the wiper portion of maintenance sled 14 is broken away to expose one of the flexible end-stop members 22 of side 16. Cap 26 is shaped to fit over the nozzles of the ink jet printhead (not shown). Wiper 30 is used for wiping residual ink from the nozzles of the ink jet printhead when the ink jet printhead is moved in the direction depicted by arrow 32 from the printing area to the maintenance area associated with maintenance station 10. Wiper 30 is preferably formed of a flexible material such as rubber. A printing carriage engaging member 34 is disposed at one end of the maintenance sled 14. Member 34 engages the printing carriage when the printing carriage moves in the direction depicted by arrow 32 into the maintenance area and moves cap 26 into the capping position as shown in FIG. 2.

The guide pins 28 are adapted to move in guide slots 20 so that guide slots 20 and the guide pins 28 operate in a cam and a cam follower like manner. When the printing carriage moves into the maintenance area of maintenance station 10, i.e., in the direction depicted by arrow 32, the printing carriage abuts the printing carriage engaging member 34, which moves maintenance sled 14 with the guide pins 28 sliding in the guide slots 20. Because the guide slots are inclined, this movement in the direction of arrow 32 shifts the maintenance sled 14 between a recessed (uncapped) position (FIG. 1 and an engaged (capped) position (FIG. 2) as guide pins 28 of maintenance sled 14 travel up the incline of guide slots 20.

When printhead maintenance is completed and printing is resumed, the printing carriage is shifted in the direction depicted by arrow 36 from the maintenance area to the printing area. As the printing carriage moves in the direction depicted by arrow 36, which may be effected by a spring (not shown), the guide pins 28 of maintenance sled 14 travel down the incline of guide slots 20 toward the recessed position until guide pins 28 reach the travel limit defined by the corresponding lower flexible end-stop member 22 associated with each of guide slots 20. Thus, the travel limit of maintenance sled 14 in the direction of arrow 36 is defined by at least one of flexible end-stop members 22.

Since each end-stop member 22 is flexible, the noise associated with the impact of maintenance sled 14 reaching the recessed position in maintenance frame 12 is reduced over that of a maintenance station that does not include the flexible end-stop members 22 of the present invention. The flexibility of end-stop members 22 permits the slow absorption of the impact energy by flexing slightly at the time of initial impact, thereby reducing the mechanical shock and noise associated with the impact.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within know or customary practice in the art to which this invention pertains and which fall within the limits of the appended claims.

What is claimed is:

1. An ink jet printer, comprising:

a printer frame; and a maintenance station coupled to said printer frame, said maintenance station including:

a maintenance frame having a first side, said first side having formed therein at least a first guide slot and a first flexible end-stop member associated with said first guide slot; and a maintenance sled movable within said maintenance frame in a first direction, said maintenance sled having a first guide member positioned to slideably ride in said first guide slot, wherein a travel limit of said first guide member in said first direction is defined by said first flexible end-stop member.

2. The ink jet printer of claim 1, wherein a shape of said first flexible end-stop member is defined by a void formed in said first side.

3. The ink jet printer of claim 1, wherein said first flexible end-stop member is defined as having a hook-shape.

4. The ink jet printer of claim 1, wherein:

said maintenance frame further having a second side, said first side and said second side each having formed therein a plurality of guide slots, each of said plurality of guide slots having associated therewith one of a plurality of flexible end-stop members; and said maintenance sled having a plurality guide members, each of said plurality of guide members positioned to slideably ride in a corresponding one of said plurality of guide slots, wherein a travel limit of said maintenance sled in said first direction is defined by at least one of said plurality of flexible end-stop members.

5. The ink jet printer of claim 1, wherein said first side includes a plurality of guide slots and a corresponding plurality of flexible end-stop members, and each of said plurality of flexible end-stop members being defined by a corresponding void formed in said first side.

6. A maintenance station for an imaging apparatus, comprising:

a maintenance frame having a first side, said first side having formed therein at least a first guide slot and a first flexible end-stop member associated with said first guide slot; and a maintenance sled movable within said maintenance frame in a first direction, said maintenance sled having a first guide member positioned to slideably ride in said first guide slot, wherein a travel limit of said maintenance sled in said first direction is defined by said first flexible end-stop member.

7. The maintenance station of claim 6, wherein a shape of said first flexible end-stop member is defined by a void formed in said first side.

8. The maintenance station of claim 6, wherein said first flexible end-stop member is defined as having a hook-shape.

9. The maintenance station of claim 6, wherein:

said maintenance frame further having a second side, said first side and said second side each having formed therein a plurality of guide slots, each of said plurality of guide slots having associated therewith one of a plurality of flexible end-stop members; and said maintenance sled having a plurality guide members, each of said plurality of guide members positioned to slideably ride in a corresponding one of said plurality of guide slots, wherein a travel limit of said maintenance sled in said first direction is defined by at least one of said plurality of flexible end-stop members.

10. The maintenance station of claim 6, wherein said first side includes a plurality of guide slots and a corresponding plurality of flexible end-stop members, and each of said plurality of flexible end-stop members being defined by a corresponding void formed in said first side.

11. A maintenance station for an ink jet printer, comprising:

a maintenance frame having a first side and a second side, each of said first side and said second side having formed therein a first guide slot and an associated first flexible end-stop member, and having a second guide slot and an associated second flexible end-stop member; and a maintenance sled movable within said maintenance frame in a first direction, said maintenance sled having a plurality of guide members, each of said plurality of guide members being positioned to slideably ride in a corresponding one of said first guide slot and said second guide slot of each of said first side and said second side, wherein a travel limit of said maintenance sled in said first direction is defined by at least one of said first flexible end-stop member and said second flexible end-stop member.

12. The maintenance station of claim 11, wherein a shape of each of said first flexible end-stop member and said second flexible end-stop member formed in each of said first side and said second side is defined by a corresponding void.

13. The maintenance station of claim 11, wherein each of said first flexible end-stop member and said second flexible end-stop member is shaped in the form of a hook.

* * * * *